US006430773B1

(12) United States Patent
Buron et al.

(10) Patent No.: US 6,430,773 B1
(45) Date of Patent: Aug. 13, 2002

(54) VACUUM CLEANER NOZZLE

(75) Inventors: Jacky Buron, La Chapelle Reanville; Jerome Fabron, Vernon, both of (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 09/600,123

(22) PCT Filed: Jan. 13, 1999

(86) PCT No.: PCT/FR99/00046

§ 371 (c)(1),
(2), (4) Date: Jul. 12, 2000

(87) PCT Pub. No.: WO99/35951

PCT Pub. Date: Jul. 22, 1999

(30) Foreign Application Priority Data

Jan. 14, 1998 (FR) ..... 98 00861

(51) Int. Cl.[7] ..... A47L 9/02
(52) U.S. Cl. ..... 15/420; 15/374
(58) Field of Search ..... 15/420, 415.1, 15/374

(56) References Cited

U.S. PATENT DOCUMENTS

| | | | | | |
|---|---|---|---|---|---|
| 1,533,368 | A | * | 4/1925 | Berg | 15/415.1 |
| 2,235,226 | A | * | 3/1941 | Lofgren et al. | 15/420 |
| 2,396,862 | A | * | 3/1946 | Linderoth | 15/371 |
| 3,512,208 | A | * | 5/1970 | Spencer | 15/420 X |
| 4,638,527 | A | * | 1/1987 | Fleischhauer | 15/371 |
| 4,653,137 | A | | 3/1987 | Fleischhauer | |
| 5,123,141 | A | * | 6/1992 | Erickson et al. | 15/415.1 X |
| 5,446,943 | A | | 9/1995 | Sovis et al. | |
| 5,987,700 | A | * | 11/1999 | Edlund | 15/420 |

FOREIGN PATENT DOCUMENTS

| | | | | |
|---|---|---|---|---|
| DE | 862654 | * | 1/1953 | 15/420 |
| DE | 1 173 623 | | 6/1959 | |
| DE | 1 815 059 | | 8/1970 | |
| DE | 297 04742 | | 11/1997 | |
| DE | 197 30 493 | | 1/1999 | |
| DK | 65819 | * | 11/1947 | 15/415.1 |
| EP | 994 018 | | 12/1998 | |
| JP | 4193136 | | 7/1992 | |
| WO | WO 84/03429 | | 9/1984 | |

* cited by examiner

*Primary Examiner*—Chris K. Moore
(74) *Attorney, Agent, or Firm*—Browdy and Neimark

(57) ABSTRACT

Vacuum cleaner nozzle having a triangular base member (4) provided with a rim having two lateral sides (18) and a rear side (21), the two lateral sides forming an angle with one another and meeting at a corner region (6) that faces in the direction in which the nozzle is pushed during vacuuming. The corner region (6) has at least one front suction opening (7) to assure a suction in a direction substantially parallel to the surface to be cleaned.

13 Claims, 7 Drawing Sheets

VACUUM CLEANER NOZZLE

TECHNICAL FIELD

The present invention relates to a vacuum cleaner nozzle having a base member, the edge of which includes two sides that meet at a corner region, and more particularly a nozzle having a base member intended to be displaced on the surface to be cleaned having an upper face provided with an air flow circuit and a lower face provided with at least two removable glides permitting the nozzle to slide on the surface to be cleaned. A T-connection, mounted in a removable manner on the upper face of the base member, permits connecting via said air flow circuit a plurality of suction openings to a removable tube for evacuation of the suctioned debris.

The invention equally concerns a vacuum cleaner having such a nozzle.

PRIOR ART

Nozzle s for vacuum cleaners in the prior art generally have forms and dimensions which cause their use to be difficult particularly to suction debris located in corners or narrow passages and to suction debris which is on surfaces obstructed by furniture. In the first case, the user is required to change the vacuum cleaner nozzle in order to reach corners or narrow passages, while in the second case, the user is required to move the furniture in order to position the base member of the nozzle over the debris.

International Patent Application No. WO84/03429 describes a vacuum cleaner nozzle of triangular form furnished with lateral section openings located below a suction cavity and between the sides of the triangle. Such a nozzle does not permit resolution of the problem mentioned hereabove to the extent where, in order to suction debris situated in a corner or in a narrow passage, the user must first of all position the nozzle above the debris. This is only possible if the angle of the corner is sufficiently large to permit the base member of the nozzle to be situated over the debris. In the case where this angle is narrow, the user is still required to change the nozzle of the vacuum cleaner in order to reach the debris.

SUMMARY OF THE INVENTION

The object of the invention is to reduce the drawbacks mentioned hereabove by means of a vacuum cleaner nozzle having a triangular base member whose rim has two adjacent lateral sides that meet at a corner region, characterized in that said corner region has at least one opening at the front of the base member intended to assure a suction in a direction substantially parallel to the surface to be cleaned.

Such a nozzle permits a suction opening to be brought as close as possible to debris located in corners or in narrow passages.

Thanks to this opening, the nozzle is capable of long range suction of debris located in corners or narrow passages even if the base member of said nozzle is not positioned above the debris.

BRIEF DESCRIPTION OF THE DRAWINGS

Other characteristics and advantages of the invention will appear from the description that will follow, taken by way of non-limiting example, with reference to the attached figures in which.

BEST MANNER OF CARRYING OUT THE INVENTION

Figure 2:
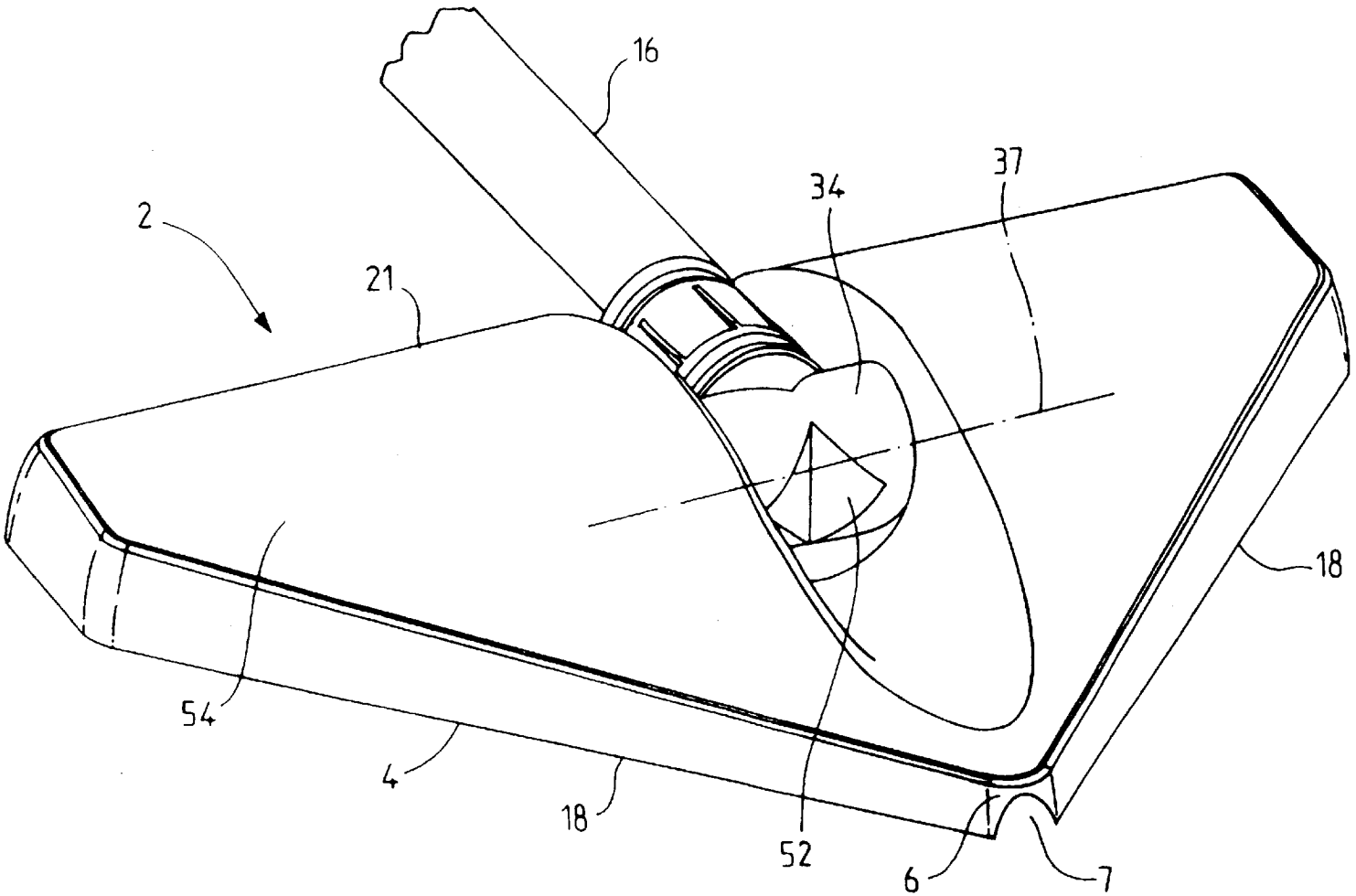
FIG. 2 shows schematically a perspective view of a nozzle according to the invention.

As can be seen in FIG. 2, vacuum cleaner nozzle 2 has a base member 4 intended to be displaced parallel to the surface to be cleaned, the rim of said base member having two adjacent sides 18 that form an angle with one another and meet at a corner region 6 connecting two sides of the nozzle and the end of which is rounded in order to avoid damaging walls and furniture during cleaning. This corner region is advantageously put to good use in a triangular nozzle such as described in the present application, by way of an exemplary embodiment, but the invention can also be applied to a nozzle of other forms, such as circular in presenting a point which forms said corner region.

According to an important characteristic of the invention, said corner region has a front opening 7 intended to assure a suction in a direction substantially parallel to the surface to be cleaned.

By front opening, there is to be understood an opening starting from the base member, where the suction channel is situated and extending on the edge of the nozzle. The opening is thus substantially perpendicular to the surface to be cleaned.

This opening is of a size sufficient to be able to suction small objects. Thus, the size of the opening is greater than 0.5 $cm^2$.

Advantageously, in order to not create a loss of suction at the level of the floor, the opening is shaped to have an opening angle at the base in such a manner that the width of the opening at its base is at least two times greater than the width at mid-height.

Figure 8:
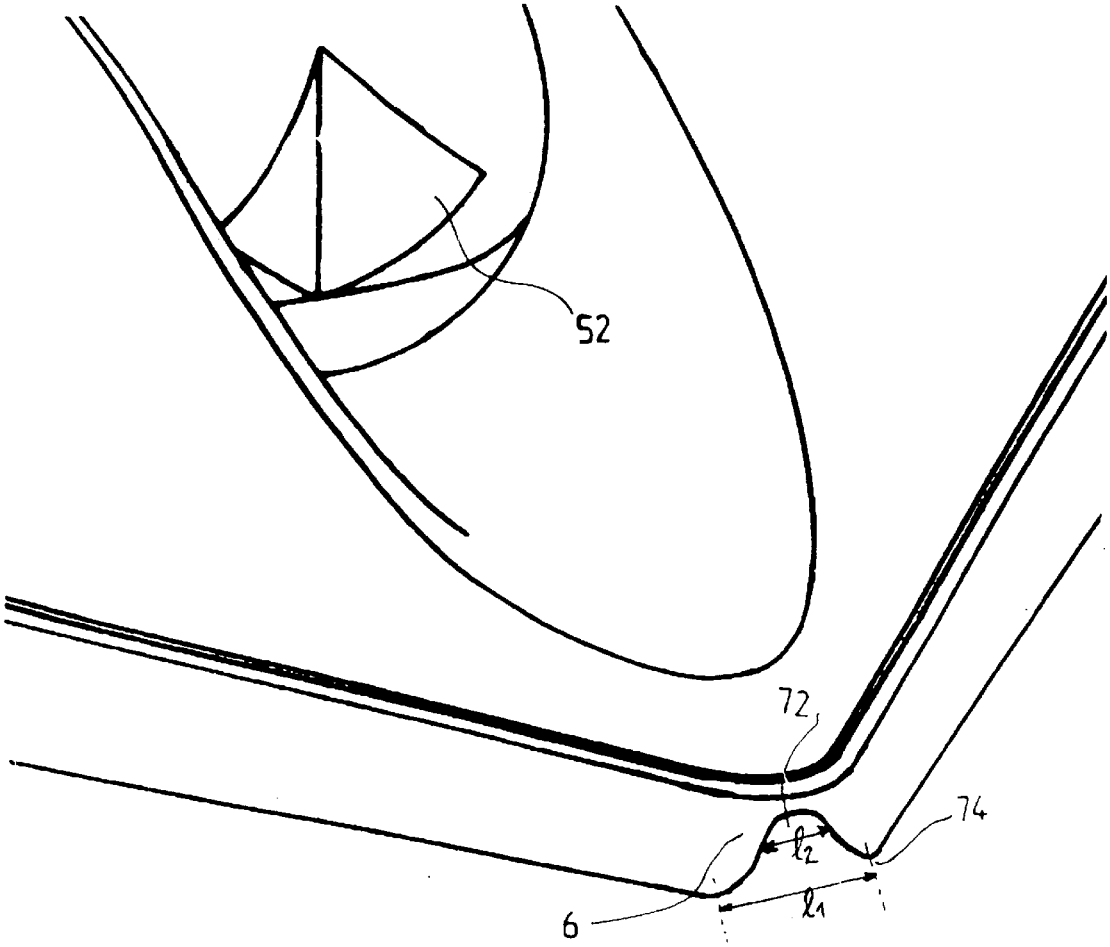
FIG. 8 shows a suction opening of the nozzle according to another form of construction.

FIG. 8 shows such an opening 72 having an opening angle 74. The width l1 at its base is at least two times as great as its width l2 at its mid-height.

Figure 3:
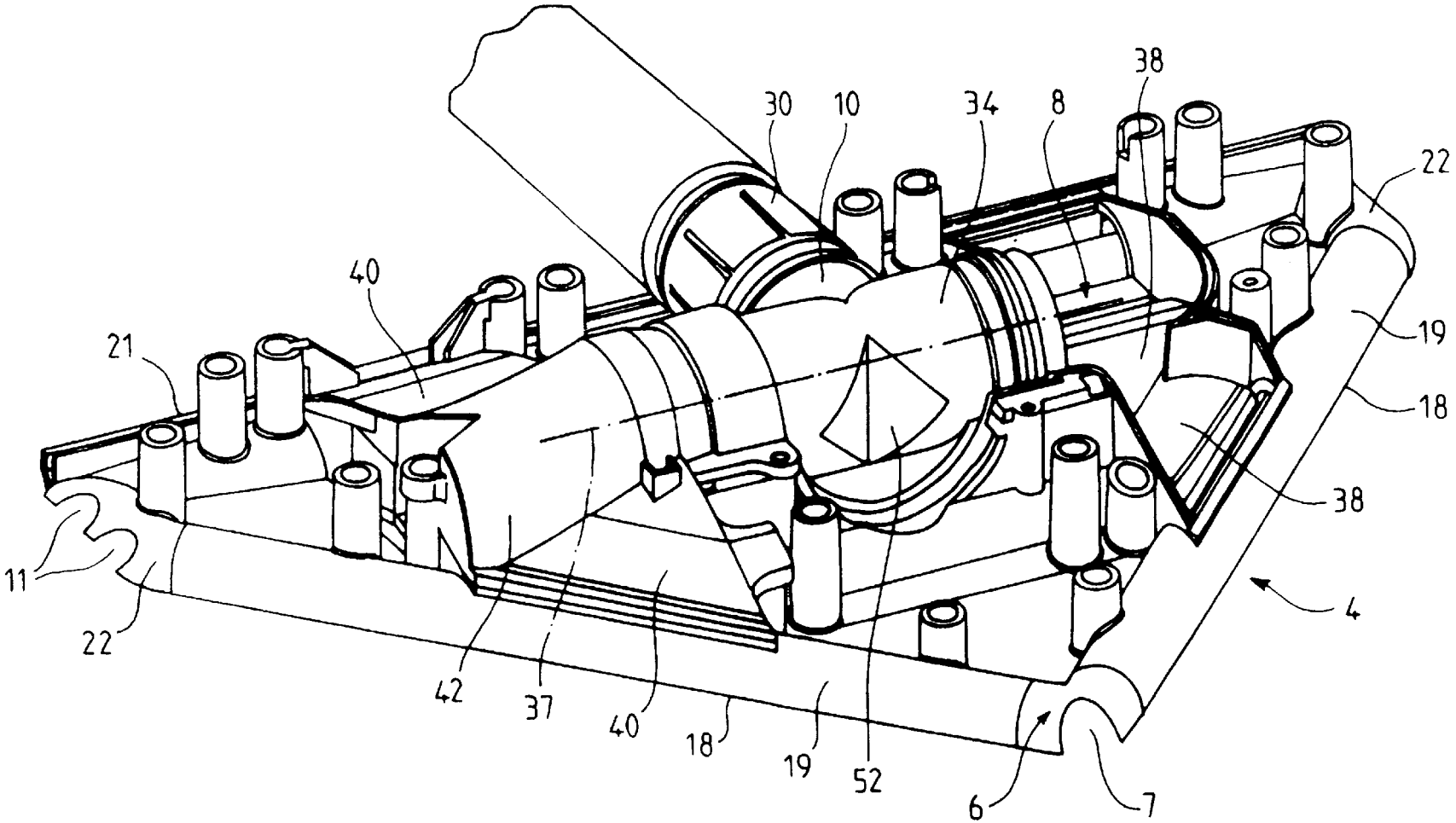
FIG. 3 shows schematically a partially exploded perspective view of the upper face of a nozzle according to the invention without its cover.
Figure 4:
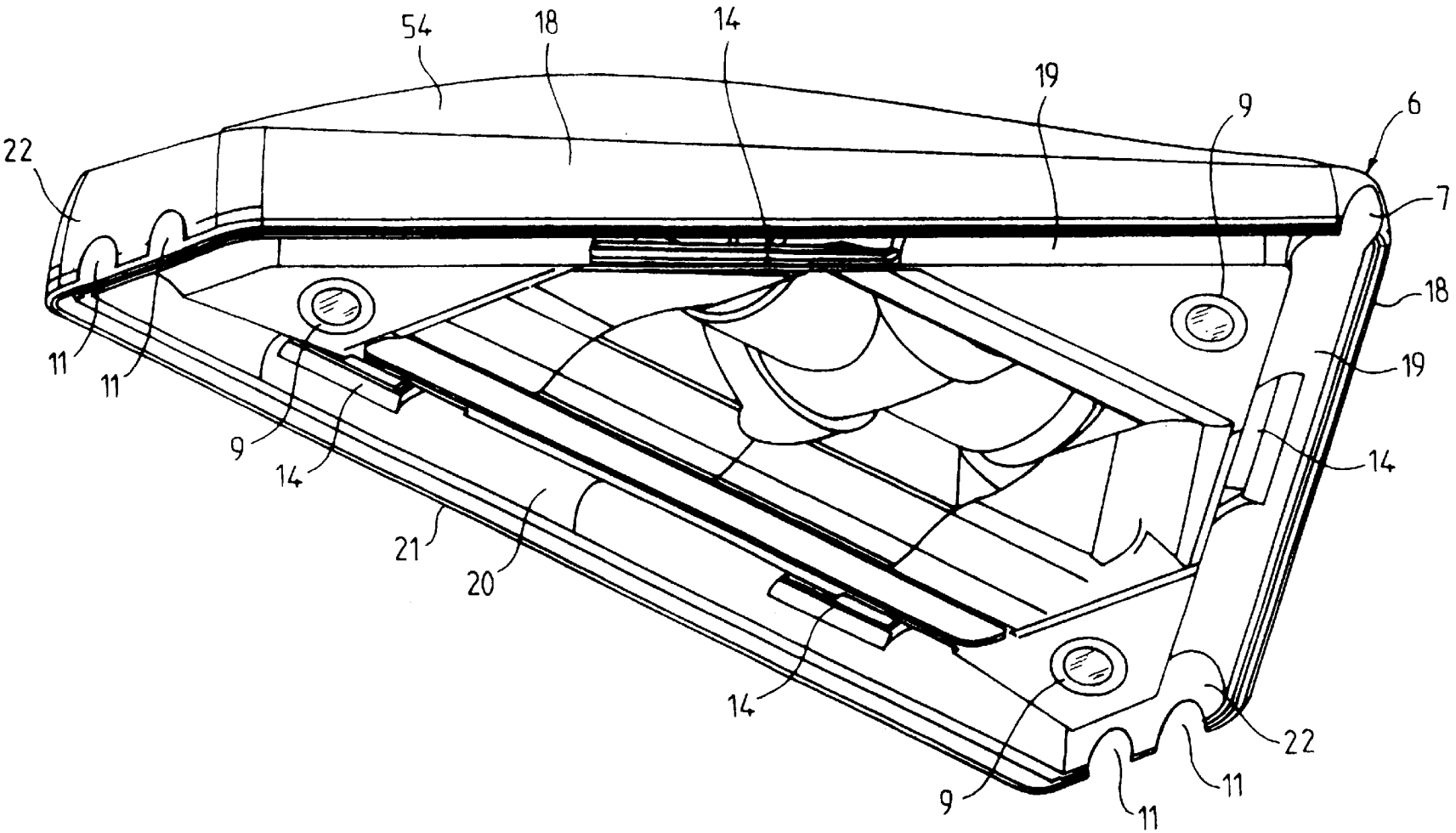
FIG. 4 shows schematically a perspective view of the lower face of a nozzle according to the invention.
Figure 5:
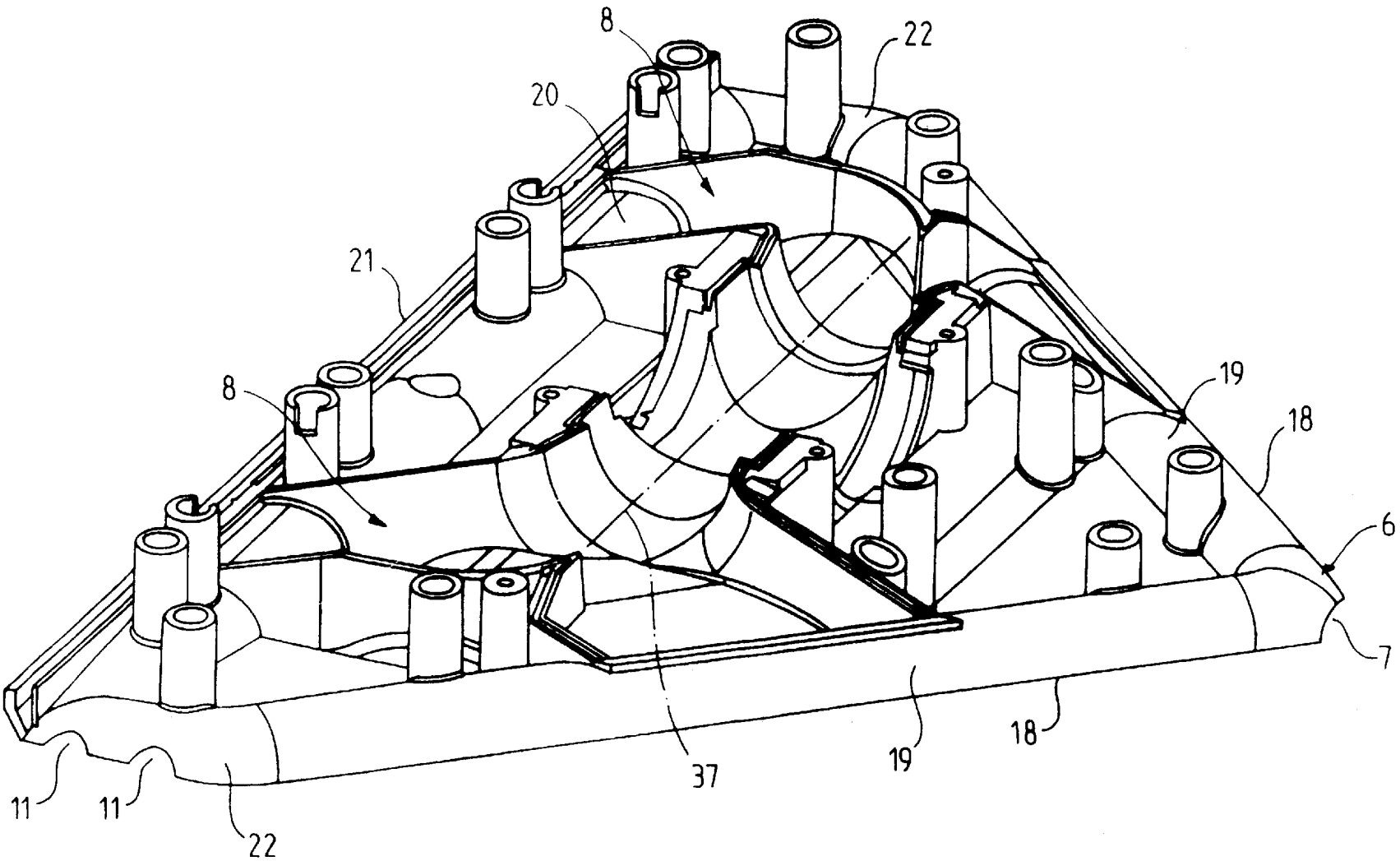
FIG. 5 shows a lateral view in perspective of the upper face of a nozzle shown in FIG. 4.
Figure 6:
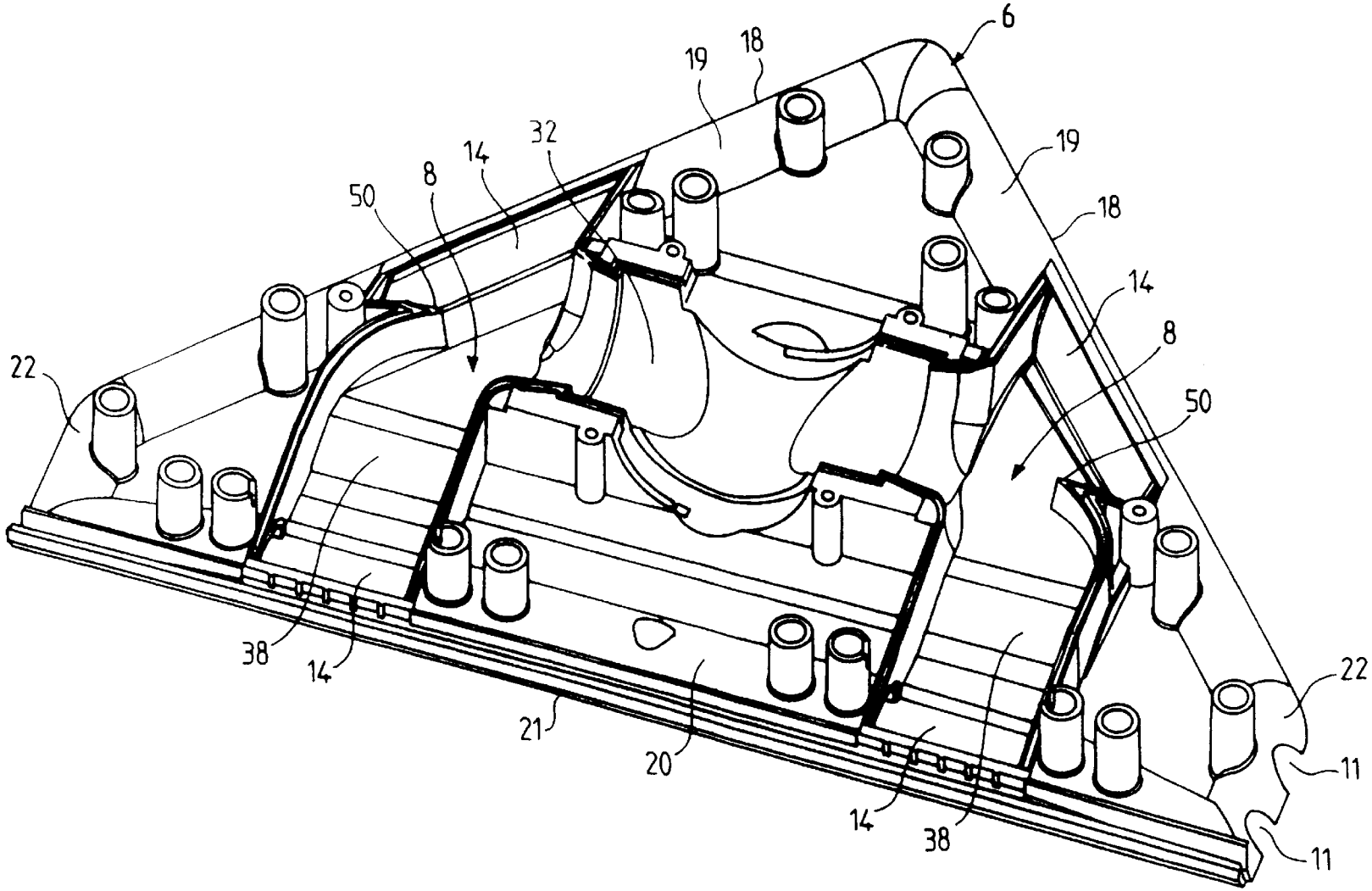
FIG. 6 shows a perspective view of the rear face of a nozzle represented in FIG. 4.

As can be seen in FIGS. 3, 5 and 6, the upper face of said base member 4 is provided with an air flow circuit 8 while, as shown in FIG. 4, its lower face has three removable slides 9 permitting displacement of the nozzle on the surface to be cleaned. A T-connection 10 (FIG. 3), mounted in a removable manner on the upper face of base member 4, permits connecting, via said air flow circuit 8, a plurality of suction openings 7, 11 and 14 (openings 14 being s shown in FIGS. 4 and 6) to a removable tube 16 (FIG. 2) for evacuation of the suctioned debris.

According to a preferred embodiment of the invention, base member 4 has a substantially triangular form of which the two adjacent sides 18 each have a lateral channel 19, shown in FIGS. 3–6, open toward the surface to be cleaned arranged along the rim of base member 4.

According to another embodiment, according to the example of the invention provided by way of illustration, and as shown in FIGS. 3–6, each of lateral channels 19 is connected to a rear channel 20 (FIGS. 4–6) arranged along the third side 21 forming the rear face of base member 4, by means of an elbow 22 open toward the surface to be cleaned substantially perpendicular to said side 21 and having at least one lateral suction opening 11.

In addition, as can be seen in FIG. 4, lateral channels 19 communicate with a lower suction opening 14 while rear channel 20 communicates with two lower suction openings 14 situated symmetrically with respect to the middle of said rear side 21. These lower suction openings 14 are intended to assure a suctioning of the debris in a direction perpendicular to the surface to be cleaned.

As can be seen in FIGS. 3, 5, and 6, air flow circuit 8 has the form of an H having a central groove 32 (FIG. 6) in which is mounted a conduit 34 (FIG. 3), constituting the horizontal bar of the T-shaped connection 10 (FIG. 3) and two lateral grooves 38 (FIG. 3) each connecting the two lower openings 14 (FIG. 6) situated on the rear channel 20 (FIG. 6) to one of the lower openings 14 (FIG. 6) situated on one of the lateral channels 19 and to conduit 34 (FIG. 3). Lateral grooves 38 (FIG. 3) of air flow circuit 8 are covered at their ends by a first cover 40 (FIG. 3) of flat form and at their middle by a second cover 42 (FIG. 3) of semi-cylindrical form prolonging conduit 34 (FIG. 3) of T-shaped connection 10 (FIG. 3).

As can be seen in FIG. 6, each of the lateral grooves 38 of the H circuit has a lateral deflector 50 situated in proximity to the meeting area of the air flow entering through lower suction openings 14 situated facing one another. Connection 10 equally has, as can be seen in FIGS. 2 and 3, two central deflectors 52 intended to prevent a frontal collision between the air flows circulating in conduit 34.

In order to prevent damage due to impacts between the nozzle and the environment during utilization of the vacuum cleaner, base member 4, as is illustrated in FIGS. 2 and 4, is covered on its upper face by a cover 54 of a flexible material also covering the external edges of sides 18 and 21 as well as elbows 22 of said base member 4. Said flexible cover 54 has, as shown in FIG. 2, at its middle a hole permitting passage of connection 10 in order to assure attachment of tube 16. It will be noted that cover 54 has essentially an impact absorbing function to the extent that air flow circuit 8 is totally covered by covers 40, 42 (FIG. 3) and by this fact the nozzle can suction debris even when cover 54 is withdrawn from the upper face of the base member.

Figure 1:
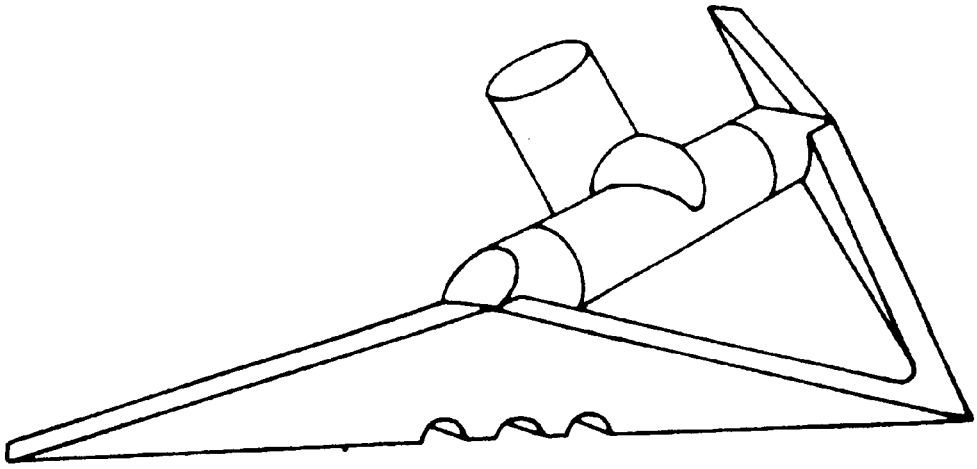
FIG. 1 schematically shows a nozzle according to the prior art described in application WO84/03429.
Figure 7:
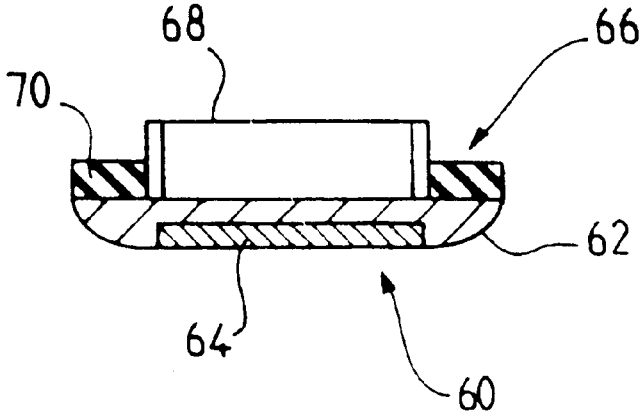
FIG. 7 shows schematically a vertical cross-sectional view of a slide equipping a nozzle according to the invention.

In order to assure a displacement of the nozzle on surfaces of different types, removable slides 9, shown schematically in FIGS. 4 and 7, have a lower surface 60 having a profiled leading edge 62 and are furnished with a central disk 64 assuring contact with the surface to be treated during displacement of the appliance. Said central disk 64 can be of PTFE (polytetrafluoroethylene) or of any other material having a good resistance to abrasion and a low coefficient of friction. The upper face 66 of said slides 9 is provided with a central ring 68 surrounded by an annular joint 70 intended to absorb vibrations when the nozzle is displaced on an uneven surface.

Advantageously, the slides are arranged on the base member in such a manner as to raise the base member from the surface to be cleaned. The distance separating the base member from the floor, which one can liken to a road clearance, by analogy to the automobile field, permits establishment of a synergy between a coarse suction through opening or openings 7, 11 and a fine suction through the sides of the base member.

This equally permits establishment of a good compromise between the ease of displacing the nozzle on the floor, due to the air leak created, and the suction vacuum.

POSSIBILITY OF INDUSTRIAL APPLICATION

The invention finds its application in the field of household vacuum cleaners.

What is claimed is:

1. Vacuum cleaner nozzle having a triangular base member (4) provided with a rim having two lateral sides (18) and a rear side (21), said two lateral sides forming an angle with one another and meeting at a corner region (6) that faces in the direction in which said nozzle is pushed during vacuuming, characterized in that said corner region (6) has at least one front suction opening (7) to assure a suction in a direction substantially parallel to the surface to be cleaned.

2. Vacuum cleaner nozzle according to claim 1, characterized in that the at least one opening has a cross-sectional area greater than 0.5 $cm^2$.

3. Vacuum cleaner nozzle according to claim 2, characterized in that the at least one opening has a configuration such that the width of the opening at its base is at least 2 times greater than its width at mid-height.

4. Vacuum cleaner nozzle according to claim 1 characterized in that said front suction opening (7) is connected to an air flow circuit (8) by at least one channel (19, 20, 22) open toward the surface to be cleaned arranged along the rim of the base member (4).

5. Vacuum cleaner nozzle according to claim 1, characterized in that said two lateral sides (18) are each furnished with a lateral channel (19), said channels (19) communicating with at least one lower suction opening (14).

6. Vacuum cleaner nozzle according to claim 5, characterized in that the rear side (21) is provided with a rear channel (20) communicating with at least one lower suction opening (14).

7. Vacuum cleaner nozzle according to claim 6, characterized in that each of said lateral channels (19) is connected to the rear channel (20) by an elbow open toward the surface to be cleaned (22), each said elbow having at least one lateral suction opening (11).

8. Nozzle according to claim 7, characterized in that said corner region has a rounded form.

9. Nozzle according to claim 6, characterized in that said corner region has a rounded form.

10. Nozzle according to claim 5, characterized in that said corner region has a rounded form.

11. Vacuum cleaner nozzle according to claim 1, further comprising slides arranged under the base member, in such a manner as to raise the base member from the floor to be cleaned by a small height in order to establish an optimum relation between a coarse suctioning via the openings as well as a fine suctioning under the sides of the base member.

12. Vacuum cleaner characterized in that it comprises a nozzle according to claim 1.

13. Vacuum cleaner nozzle according to claim 1, characterized in that the at least one opening has a configuration such that the width of the opening at its base is at least 2 times greater than its width at mid-height.

* * * * *